US010997983B2

(12) United States Patent
Furuta

(10) Patent No.: US 10,997,983 B2
(45) Date of Patent: May 4, 2021

(54) SPEECH ENHANCEMENT DEVICE, SPEECH ENHANCEMENT METHOD, AND NON-TRANSITORY COMPUTER-READABLE MEDIUM

(71) Applicant: MITSUBISHI ELECTRIC CORPORATION, Tokyo (JP)

(72) Inventor: Satoru Furuta, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 37 days.

(21) Appl. No.: 16/343,946

(22) PCT Filed: Dec. 8, 2016

(86) PCT No.: PCT/JP2016/086502

§ 371 (c)(1),
(2) Date: Apr. 22, 2019

(87) PCT Pub. No.: WO2018/105077

PCT Pub. Date: Jun. 14, 2018

(65) Prior Publication Data

US 2019/0287547 A1 Sep. 19, 2019

(51) Int. Cl.
*G10L 21/0364* (2013.01)
*G10L 21/0316* (2013.01)
(Continued)

(52) U.S. Cl.
CPC ..... *G10L 21/0364* (2013.01); *G10L 21/0316* (2013.01); *H04R 3/04* (2013.01); *H04R 25/00* (2013.01); *H04S 7/00* (2013.01)

(58) Field of Classification Search
CPC . G10L 21/0364; G10L 21/0316; H04R 25/00; H04R 3/04; H04S 7/00; H04S 2420/07
(Continued)

(56) References Cited

U.S. PATENT DOCUMENTS 4,443,859 A * 4/1984 Wiggins ..... H03H 17/0285 708/318
5,999,630 A * 12/1999 Iwamatsu ..... H04S 1/002 381/17

(Continued)

FOREIGN PATENT DOCUMENTS

JP 8-146974 A 6/1996
JP 5351281 B2 11/2013
WO WO 2011/064950 A1 6/2011

OTHER PUBLICATIONS

Chaudhari et al., "Dichotic Presentation of Speech Signal Using Critical Filter Bank for Bilateral Sensorineural Hearing Impairment", Proc. 16th ICA (Seattle, Wash., U.S.A., Jun. 20-26, 1998), vol. 1, pp. 213-214.

(Continued)

*Primary Examiner* — Edwin S Leland, III
(74) *Attorney, Agent, or Firm* — Birch, Stewart, Kolasch & Birch, LLP

(57) ABSTRACT

A speech enhancement device includes: a filter to extract, from an input signal, a component in a frequency band including a fundamental frequency of speech, as a first filter signal; a filter to extract, from the input signal, a component in a frequency band including a first formant of speech, as a second filter signal; a filter to extract, from the input signal, a component in a frequency band including a second formant of speech, as a third filter signal; a mixer to mix the first and second filter signals, thereby outputting a first mixed signal; a mixer to mix the first and third filter signals, thereby outputting a second mixed signal; a controller to delay the first mixed signal, thereby generating a first speech signal for a first ear; and a controller to delay the second mixed signal thereby generating a second speech signal for a second ear.

11 Claims, 10 Drawing Sheets

(51) Int. Cl.
*H04R 25/00* (2006.01)
*H04S 7/00* (2006.01)
*H04R 3/04* (2006.01)

(58) Field of Classification Search
USPC ..... 704/205
See application file for complete search history.

(56) References Cited

U.S. PATENT DOCUMENTS

| | | | | |
|---|---|---|---|---|
| 8,010,348 | B2 * | 8/2011 | Son | G10L 19/20 704/203 |
| 10,375,493 | B2 * | 8/2019 | Lesso | H04R 3/04 |
| 2004/0252850 | A1 * | 12/2004 | Turicchia | G10L 21/0364 381/94.2 |
| 2011/0085686 | A1 * | 4/2011 | Bhandari | H04R 3/005 381/313 |
| 2011/0280424 | A1 * | 11/2011 | Takagi | H04R 25/50 381/317 |
| 2019/0287547 | A1 * | 9/2019 | Furuta | G10L 21/0316 |

OTHER PUBLICATIONS

International Search Report for PCT/JP2016/086502 (PCT/ISA/210) dated Feb. 7, 2017.
Chinese Office Action and Search Report dated Jul. 30, 2020 for Application No. 201680091248.0 with an English translation of the Office Action.

* cited by examiner

SPEECH ENHANCEMENT DEVICE, SPEECH ENHANCEMENT METHOD, AND NON-TRANSITORY COMPUTER-READABLE MEDIUM

TECHNICAL FIELD

The present invention relates to a speech enhancement device, a speech enhancement method, and a speech processing program for generating, from an input signal, a first speech signal for one ear and a second speech signal for the other ear.

BACKGROUND ART

In recent years, studies have been made on advanced driver assistance systems (ADAS) for assistance for driving an automobile. Important functions of ADAS include, for example, a function of providing voice guidance that is clear and easy to hear for even an aged driver, and a function of providing comfortable hands-free telephone conversation even under a high noise environment. Also, in the field of television receivers, studies have been made to make broadcast speech output from a television receiver easier to hear when an aged person is watching television.

By the way, in auditory psychology, a phenomenon called auditory masking is known in which a sound capable of being clearly heard in a normal situation is masked (interfered) and made hard to hear by another sound. Auditory masking includes frequency masking in which a sound of a certain frequency component is masked and made hard to hear by a loud sound of another frequency component having a nearby frequency, and temporal masking in which a subsequent sound is masked and made hard to hear by a preceding sound. In particular, aged persons are susceptible to auditory masking and tend to have a decreased ability to hear vowels and subsequent sounds.

As a countermeasure thereto, there have been proposed hearing aid methods for persons having decreased auditory frequency resolution and temporal resolution (see, e.g., Non Patent Literature 1 and Patent Literature 1). These hearing aid methods use a hearing aid method called dichotic-listening binaural hearing aid that divides an input signal on the frequency axis and presents two signals with different signal characteristics generated by the division to respective left and right ears to have a single sound perceived in the brain of the user (listener), in order to reduce the effect of auditory masking (simultaneous masking).

It is reported that dichotic-listening binaural hearing aid improves the clarity of speech for users. This may be because presenting an acoustic signal in a frequency band (or time region) of a masking sound and an acoustic signal in a frequency band (or time region) of a masked sound to respective different ears makes it easier for the user to perceive the masked sound.

CITATION LIST

Non Patent Literature

Non Patent Literature 1: D. S. Chaudhari and P. C. Pandey, "Dichotic Presentation of Speech Signal Using Critical Filter Bank for Bilateral Sensorineural Hearing Impairment", Proc. 16th ICA, Seattle Wash. USA, June 1998, vol. 1, pp. 213-214

Patent Literature

Patent Literature 1: Japanese Patent No. 5351281 (pages 8-12 and FIG. 7)

SUMMARY OF INVENTION

Technical Problem

However, the above conventional hearing aid method fails to present a pitch frequency component that is a component at a fundamental frequency of speech to both ears, and thus has a problem in that when hearing aids using this method are used by a person with mild hearing loss or a person with normal hearing, speech is hard to hear because the auditory balance between the left and right ears is poor, e.g., the speech is heard louder in one ear or heard double.

Further, the above conventional hearing aid method is intended to be applied to earphone hearing aids for hearing-impaired persons, and is not intended to be applied to devices other than earphone hearing aids. Thus, the above conventional hearing aid method is not intended to be applied to sound radiating systems (or loudspeaker systems), and, for example, in a system that uses two-channel stereo speakers to allow radiated sounds to be heard, sounds radiated by the left and right speakers reach the left and right ears at slightly different times, which may reduce the effect of dichotic-listening binaural hearing aid.

The present invention has been made to solve the problems as described above, and is intended to provide a speech enhancement device, a speech enhancement method, and a speech processing program capable of generating speech signals that cause clear and easy-to-hear radiated speech sounds to be output.

Solution to Problem

A speech enhancement device according to the present invention is a speech enhancement device to receive an input signal and generate, from the input signal, a first speech signal for a first ear and a second speech signal for a second ear opposite the first ear, and includes: a first filter to extract, from the input signal, a first band component in a predetermined frequency band including a fundamental frequency of speech, and output the first band component as a first filter signal; a second filter to extract, from the input signal, a second band component in a predetermined frequency band including a first formant of speech, and output the second band component as a second filter signal; a third filter to extract, from the input signal, a third band component in a predetermined frequency band including a second formant of speech, and output the third band component as a third filter signal; a first mixer to mix the first filter signal and the second filter signal, and thereby output a first mixed signal; a second mixer to mix the first filter signal and the third filter signal, and thereby output a second mixed signal; a first delay controller to delay the first mixed signal by a predetermined first delay amount, and thereby generate the first speech signal; and a second delay controller to delay the second mixed signal by a predetermined second delay amount, and thereby generate the second speech signal.

A speech enhancement method according to the present invention is a speech enhancement method for receiving an input signal and generating, from the input signal, a first speech signal for a first ear and a second speech signal for a second ear opposite the first ear, and includes the steps of: extracting, from the input signal, a first band component in a predetermined frequency band including a fundamental frequency of speech, and outputting the first band component as a first filter signal; extracting, from the input signal, a second band component in a predetermined frequency band including a first formant of speech, and outputting the second band component as a second filter signal; extracting, from the input signal, a third band component in a predetermined frequency band including a second formant of speech, and outputting the third band component as a third filter signal; mixing the first filter signal and the second filter signal, and thereby outputting a first mixed signal; mixing the first filter signal and the third filter signal, and thereby outputting a second mixed signal; delaying the first mixed signal by a predetermined first delay amount, and thereby generating the first speech signal; and delaying the second mixed signal by a predetermined second delay amount, and thereby generating the second speech signal.

Advantageous Effects of Invention

With the present invention, it is possible to generate speech signals that cause clear and easy-to-hear radiated speech sounds to be output.

DESCRIPTION OF EMBODIMENTS

Figure 1:
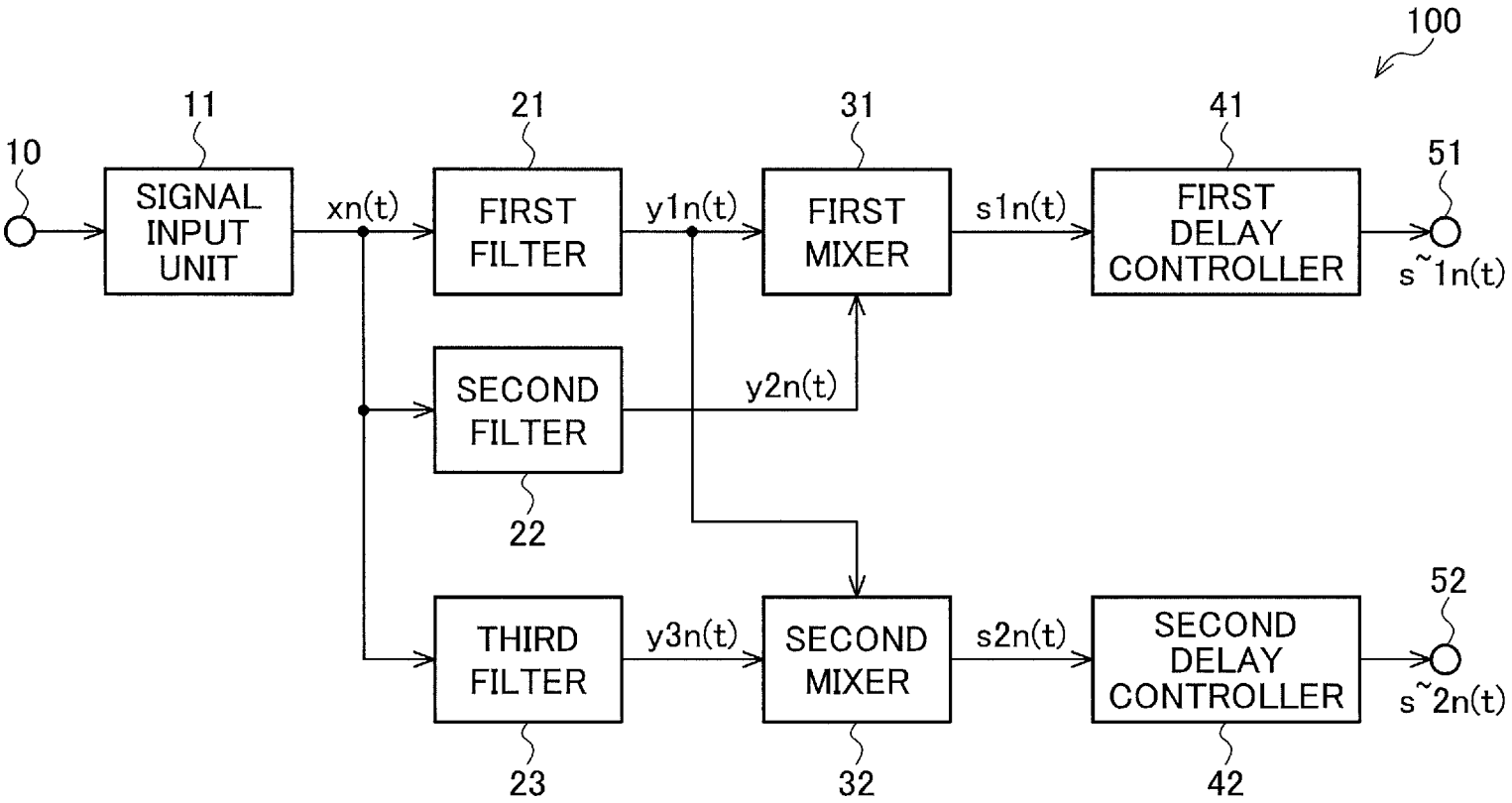
FIG. 1 is a functional block diagram illustrating a schematic configuration of a speech enhancement device according to a first embodiment of the present invention.

Embodiments of the present invention will be described below with reference to the attached drawings. In all the drawings, elements given the same reference characters have the same configurations and the same functions.

<<1>> First Embodiment

<<1-1>> Configuration

FIG. 1 is a functional block diagram illustrating a schematic configuration of a speech (or voice) enhancement device 100 according to a first embodiment of the present invention. The speech enhancement device 100 is a device capable of performing a speech enhancement method according to the first embodiment and a speech processing program according to the first embodiment.

As illustrated in FIG. 1, the speech enhancement device 100 includes, as its main elements, a signal input unit (or signal receiver) 11, a first filter 21, a second filter 22, a third filter 23, a first mixer 31, a second mixer 32, a first delay controller 41, and a second delay controller 42. In FIG. 1, 10 denotes an input terminal, 51 denotes a first output terminal, and 52 denotes a second output terminal.

The speech enhancement device 100 receives an input signal through the input terminal 10, generates, from the input signal, a first speech signal for one (first) ear and a second speech signal for the other (second) ear, and outputs the first speech signal through the first output terminal 51 and the second speech signal through the second output terminal 52.

The input signal of the speech enhancement device 100 is, for example, a signal obtained by receiving, through line cable or the like, an acoustic signal of speech, music, noise, or the like picked up through an acoustic transducer, such as a microphone (not illustrated) and an acoustic wave vibration sensor (not illustrated), or an electrical acoustic signal output from an external device, such as a wireless telephone set, a wire telephone set, and a television set. Here, description will be made using a speech signal collected by a single-channel (monaural) microphone as an example of the acoustic signal.

An operational principle of the speech enhancement device 100 according to the first embodiment will be described below with reference to FIG. 1.

The signal input unit 11 performs analog/digital (A/D) conversion on an acoustic signal included in the input signal, then performs sampling processing at a predetermined sampling frequency (e.g., 16 kHz), and takes them with predetermined frame intervals (e.g., 10 ms), thereby obtaining an input signal $x_n(t)$, which is a discrete signal in the time domain, and outputs it to each of the first filter 21, second filter 22, and third filter 23. Here, the input signal is divided into frames, each of which is assigned a frame number, and n denotes the frame number; t denotes a discrete time number (an integer not less than 0) in the sampling.

Figure 2A:
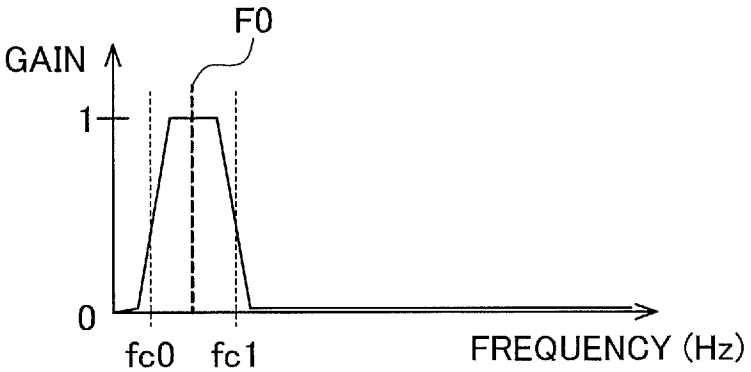
FIG. 2A is an explanatory diagram illustrating a frequency characteristic of a first filter.
Figure 2B:
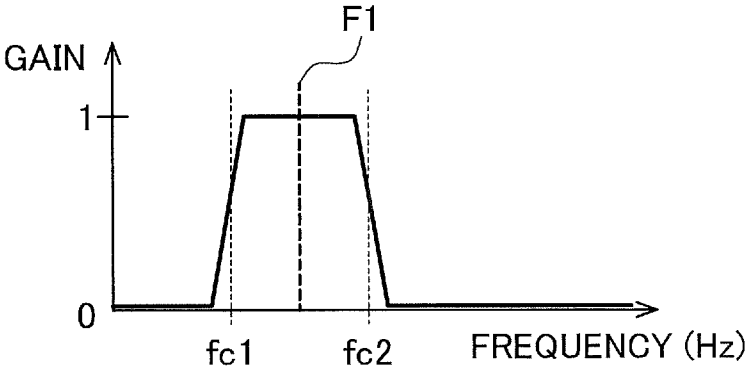
FIG. 2B is an explanatory diagram illustrating a frequency characteristic of a second filter.
Figure 2C:
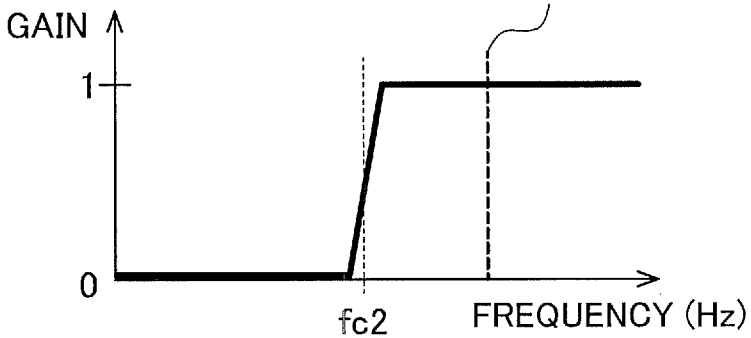
FIG. 2C is an explanatory diagram illustrating a frequency characteristic of a third filter.
Figure 2D:
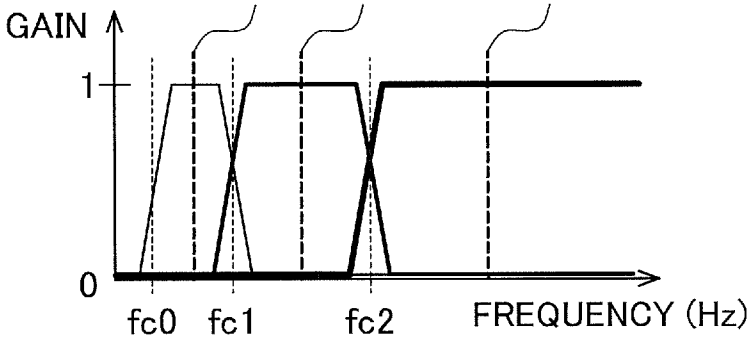
FIG. 2D is an explanatory diagram illustrating a relationship between a fundamental frequency and formants, with the frequency characteristics of all the filters superposed.

FIG. 2A is an explanatory diagram illustrating a frequency characteristic of the first filter 21; FIG. 2B is an explanatory diagram illustrating a frequency characteristic of the second filter 22; FIG. 2C is an explanatory diagram illustrating a frequency characteristic of the third filter 23; FIG. 2D is an explanatory diagram illustrating a relationship between a fundamental frequency and formants, with the frequency characteristics of all the filters superposed.

The first filter 21 receives the input signal $x_n(t)$, extracts, from the input signal $x_n(t)$, a first band component in a predetermined frequency band (passband) including a fundamental frequency (also referred to as a pitch frequency) F0 of speech, and outputs the first band component as a first filter signal $y1_n(t)$. That is, the first filter 21 passes the first band component in the frequency band including the fundamental frequency F0 of speech in the input signal $x_n(t)$ and blocks the frequency components other than the first band component, thereby outputting the first filter signal $y1_n(t)$. The first filter 21 is formed by, for example, a bandpass filter having the characteristic as illustrated in FIG. 2A. In FIG. 2A, fc0 denotes a lower cutoff frequency of the passband of the bandpass filter forming the first filter 21, and fc1 denotes an upper cutoff frequency of the passband. Also, in FIG. 2A, F0 schematically represents a spectrum component at the fundamental frequency. As the bandpass filter, a finite impulse response (FIR) filter, an infinite impulse response (IIR) filter, or the like can be used, for example.

The second filter 22 receives the input signal $x_n(t)$, extracts, from the input signal $x_n(t)$, a second band component in a predetermined frequency band (passband) including a first formant F1 of speech, and outputs the second band component as a second filter signal $y2_n(t)$. That is, the second filter 22 passes the second band component in the frequency band including the first formant F1 of speech in the input signal $x_n(t)$ and blocks the frequency components other than the second band component, thereby outputting the second filter signal $y2_n(t)$. The second filter 22 is formed by, for example, a bandpass filter having the characteristic as illustrated in FIG. 2B. In FIG. 2B, fc1 denotes a lower cutoff frequency of the passband of the bandpass filter forming the second filter 22, and fc2 denotes an upper cutoff frequency of the passband. Also, in FIG. 2B, F1 schematically represents a spectrum component at the first formant. As the bandpass filter, an FIR filter, an IIR filter, or the like can be used, for example.

The third filter 23 receives the input signal $x_n(t)$, extracts, from the input signal $x_n(t)$, a third band component in a predetermined frequency band (passband) including a second formant F2 of speech, and outputs the third band component as a third filter signal $y3_n(t)$. That is, the third filter 23 passes the third band component in the frequency band including the second formant F2 of speech in the input signal $x_n(t)$ and blocks the frequency components other than the third band component, thereby outputting the third filter signal $y3_n(t)$. The third filter 23 is formed by, for example, a bandpass filter having the characteristic as illustrated in FIG. 2C. In FIG. 2C, fc2 denotes a lower cutoff frequency of the passband of the bandpass filter forming the third filter 23. In the example of FIG. 2C, the third filter 23 passes frequency components at and above the cutoff frequency fc2. However, the third filter 23 may be a bandpass filter having an upper cutoff frequency. Also, in FIG. 2C, F2 schematically represents a spectrum component of the second formant. As the bandpass filter, an FIR filter, an IIR filter, or the like can be used, for example.

It is known that, although slightly varying by gender and individual, the fundamental frequency F0 of speech is generally distributed in a band of 125 Hz to 400 Hz, the first formant F1 is generally distributed in a band of 500 Hz to 1200 Hz, and the second formant F2 is generally distributed in a band of 1500 Hz to 3000 Hz. Thus, in one preferable example of the first embodiment, fc0=50 Hz, fc1=450 Hz, and fc2=1350 Hz. However, these values are not limited to the above examples, and may be adjusted depending on the state of a speech signal included in the input signal. Regarding the cutoff characteristics of the first filter 21, second filter 22, and third filter 23, in a preferable example of the first embodiment, when they are FIR filters, they are filters having about 96 filter taps, and when they are IIR filters, they are filters having a sixth-order butterworth characteristic. However, the first filter 21, second filter 22, and third filter 23 are not limited to these examples, and may be adjusted as appropriate depending on external devices, such as speakers, connected to the first and second output terminals 51 and 52 of the speech enhancement device 100 according to the first embodiment and hearing characteristics of the user (listener).

As above, by using the first filter 21, second filter 22, and third filter 23, it is possible to separate, from the input signal $x_n(t)$, the component in the band including the fundamental frequency F0 of speech, the component in the band including the first formant F1, and the component in the band including the second formant F2, as illustrated in FIG. 2D.

Figure 3B:
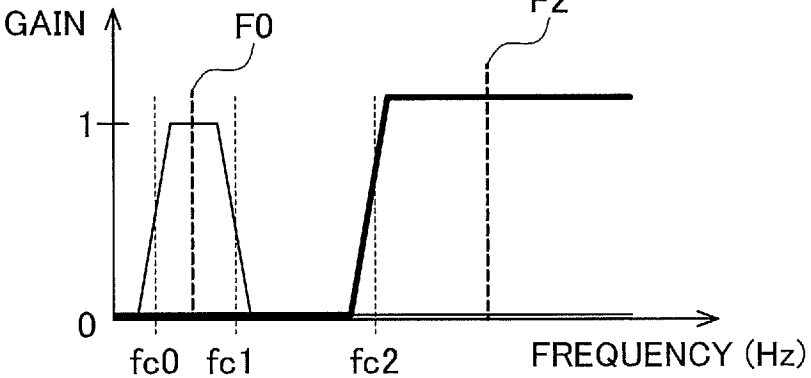
FIG. 3B is an explanatory diagram illustrating a frequency characteristic of a second mixed signal.
Figure 3A:
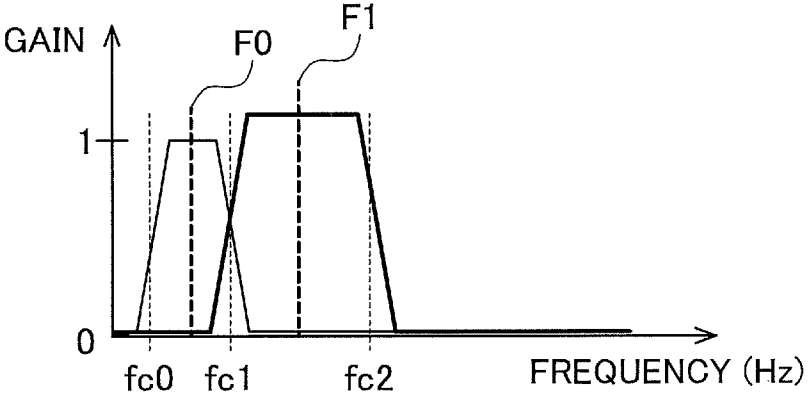
FIG. 3A is an explanatory diagram illustrating a frequency characteristic of a first mixed signal.

FIG. 3A is an explanatory diagram illustrating a frequency characteristic of a first mixed signal $s1_n(t)$, and FIG. 3B is an explanatory diagram illustrating a frequency characteristic of a second mixed signal $s2_n(t)$.

The first mixer 31 mixes the first filter signal $y1_n(t)$ and second filter signal $y2_n(t)$, thereby generating the first mixed signal $s1_n(t)$ as illustrated in FIG. 3A. Specifically, the first mixer 31 receives the first filter signal $y1_n(t)$ output from the first filter 21 and the second filter signal $y2_n(t)$ output from the second filter 22, and mixes the first filter signal $y1_n(t)$ and second filter signal $y2_n(t)$ according to the following formula (1) to output the first mixed signal $s1_n(t)$:

$$s1_n(t)=\alpha\cdot y1_n(t)+\beta\cdot y2_n(t)$$

$$0\leq t<160. \tag{1}$$

In formula (1), α and β are predetermined constants (coefficients) for correcting the auditory volume of the mixed signal. In the first mixed signal $s1_n(t)$, since the second formant component F2 is attenuated, it is desirable to compensate for lack of volume in a high range with the constants α and β. In one preferable example of the first embodiment, α=1.0 and β=1.2. The first mixer 31 mixes the first filter signal $y1_n(t)$ and second filter signal $y2_n(t)$ at a predetermined first mixing ratio (i.e., α:β). The values of the constants α and β are not limited to the above examples, and may be adjusted as appropriate depending on external devices, such as speakers, connected to the first and second output terminals 51 and 52 of the speech enhancement device 100 according to the first embodiment and hearing characteristics of the user.

The second mixer 32 mixes the first filter signal $y1_n(t)$ and third filter signal $y3_n(t)$, thereby generating the second mixed signal $s2_n(t)$ as illustrated in FIG. 3B. Specifically, the second mixer 32 receives the first filter signal $y1_n(t)$ output from the first filter 21 and the third filter signal $y3_n(t)$ output from the third filter 23, and mixes the first filter signal $y1_n(t)$ and third filter signal $y3_n(t)$ according to the following formula (2) to output the second mixed signal $s2_n(t)$:

$$s2_n(t)=\alpha\cdot y1_n(t)+\beta\cdot y3_n(t)$$

$$0\leq t<160. \tag{2}$$

In formula (2), α and β are predetermined constants for correcting the auditory volume of the mixed signal. The values of the constants α and β in formula (2) may differ from those in formula (1). Similarly to the first mixed signal $s1_n(t)$, in the second mixed signal $s2_n(t)$, since the first formant component F1 is attenuated, the two constants compensate for lack of volume in a high range. In one preferable example of the first embodiment, $\alpha=1.0$ and $\beta=1.2$. The second mixer 32 mixes the first filter signal $y1_n(t)$ and third filter signal $y3_n(t)$ at a predetermined second mixing ratio (i.e., $\alpha:\beta$). The values of the constants $\alpha$ and $\beta$ are not limited to the above examples, and may be adjusted as appropriate depending on external devices, such as speakers, connected to the first and second output terminals 51 and 52 of the speech enhancement device 100 according to the first embodiment and hearing characteristics of the user.

The first delay controller 41 delays the first mixed signal $s1_n(t)$ by a predetermined first delay amount, thereby generating a first speech signal $s\tilde{}1_n(t)$. That is, the first delay controller 41 controls a first delay amount that is a delay amount of the first mixed signal $s1_n(t)$ output from the first mixer 31, i.e., controls a time delay of the first mixed signal $s1_n(t)$. Specifically, the first delay controller 41 outputs a first speech signal $s\tilde{}1_n(t)$ obtained by adding a time delay of $D_1$ samples according to the following formula (3), for example:

$$s\tilde{}1_n(t) = \begin{cases} s1_n(t - D_1), & t \geq D_1 \\ s1_{n-1}(160 - D_1 + t), & t < D_1 \end{cases}. \quad (3)$$

The second delay controller 42 delays the second mixed signal $s2_n(t)$ by a predetermined second delay amount, thereby generating a second speech signal $s\tilde{}2_n(t)$. That is, the second delay controller 42 controls a second delay amount that is a delay amount of the second mixed signal $s2_n(t)$ output from the second mixer 32, i.e., controls a time delay of the second mixed signal $s2_n(t)$. Specifically, the second delay controller 42 outputs a second speech signal $s\tilde{}2_n(t)$ obtained by adding a time delay of $D_2$ samples according to the following formula (4), for example:

$$s\tilde{}2_n(t) = \begin{cases} s2_n(t - D_2), & t \geq D_2 \\ s2_{n-1}(160 - D_2 + t), & t < D_2 \end{cases}. \quad (4)$$

In the first embodiment, the first speech signal $s\tilde{}1_n(t)$ output from the first delay controller 41 is output to an external device through the first output terminal 51, and the second speech signal $s\tilde{}2_n(t)$ output from the second delay controller 42 is output to another external device through the second output terminal 52. The external devices are, for example, audio acoustic processing devices provided in a television set, a hands-free telephone set, or the like. The audio acoustic processing devices are devices including a signal amplifying device, such as a power amplifier, and an audio output unit, such as a speaker. Also, when the speech signals obtained through the enhancement processing are output to and recorded in a recording device (or recorder), such as an integrated circuit (IC) recorder, the recorded speech signals may be output by separate audio acoustic processing devices.

The first delay amount $D_1$ ($D_1$ samples) is a time not less than 0, the second delay amount $D_2$ ($D_2$ samples) is a time not less than 0, and the first delay amount $D_1$ and second delay amount $D_2$ may have different values. The first delay controller 41 and second delay controller 42 serve to control the first delay amount $D_1$ of the first speech signal $s\tilde{}1_n(t)$ and the second delay amount $D_2$ of the second speech signal $s\tilde{}2_n(t)$ when a distance from a first speaker (e.g., left speaker) connected to the first output terminal 51 to a first ear (e.g., the left ear) of the user differs from a distance from a second speaker (e.g., right speaker) connected to the second output terminal 52 to a second ear (which is the ear opposite the first ear, and is, e.g., the right ear) of the user. In the first embodiment, it is possible to adjust the first delay amount $D_1$ and second delay amount $D_2$ to make the time when the user hears sound based on the first speech signal $s\tilde{}1_n(t)$ in the first ear close to (desirably, coincident with) the time when the user hears sound based on the second speech signal $s\tilde{}2_n(t)$ in the second ear.

<<1-2>> Operation

Figure 4:
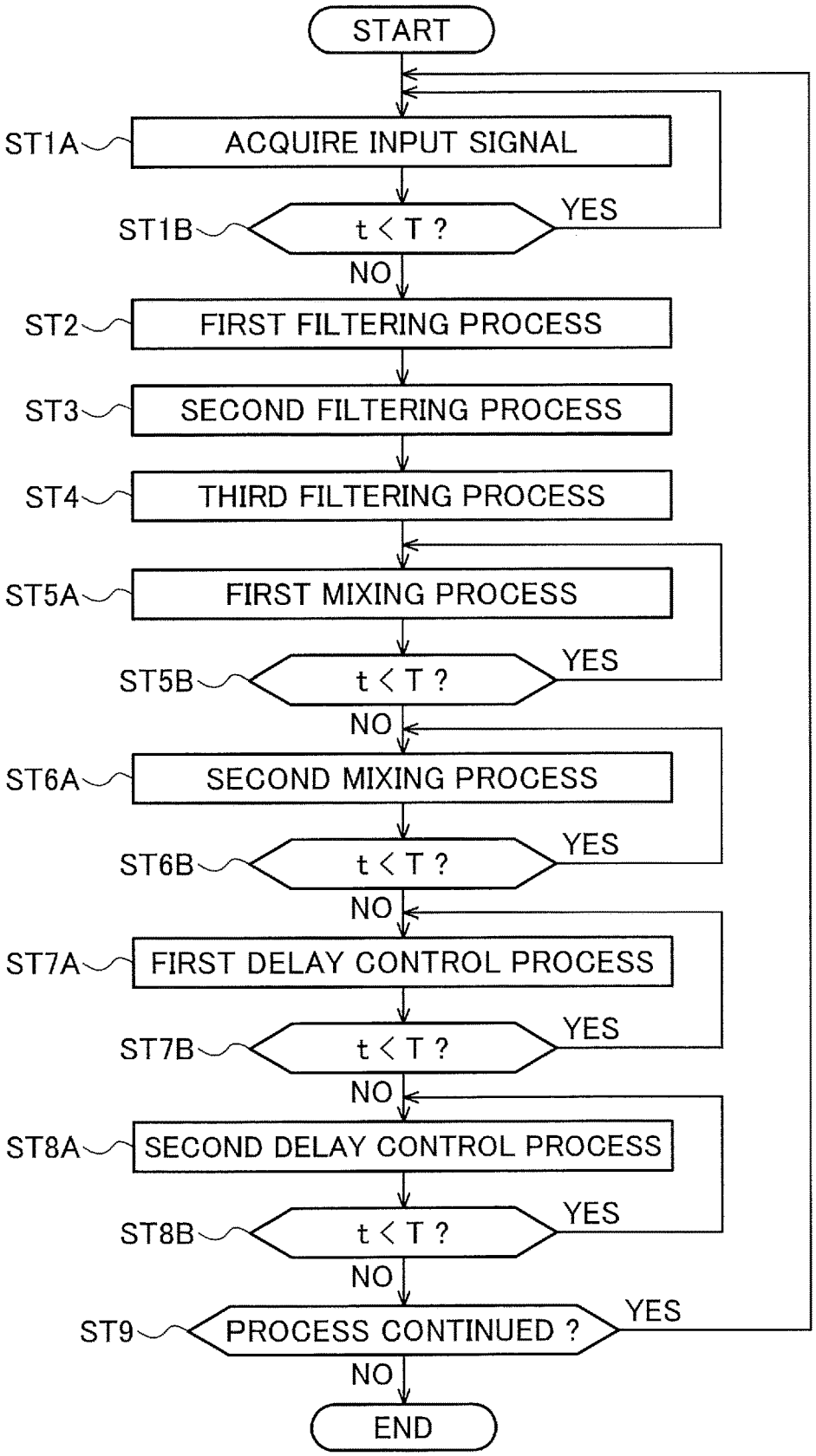
FIG. 4 is a flowchart illustrating an example of a speech enhancement process (speech enhancement method) performed by the speech enhancement device according to the first embodiment.

Next, an example of an operation (algorism) of the speech enhancement device 100 will be described. FIG. 4 is a flowchart illustrating an example of a speech enhancement process (the speech enhancement method) performed by the speech enhancement device 100 according to the first embodiment.

The signal input unit 11 acquires an acoustic signal with predetermined frame intervals (step ST1A), and performs a process of outputting it as an input signal $x_n(t)$, which is a signal in the time domain, to the first filter 21, second filter 22, and third filter 23. When the sample number t is less than a predetermined value T (YES in step ST1B), the process of step ST1A is repeated until the sample number t reaches the value T. For example, T=160. However, T may be set to a value other than 160.

The first filter 21 receives the input signal $x_n(t)$, and performs a first filtering process of passing only the first band component (low range component) in the frequency band including the fundamental frequency F0 of speech in the input signal $x_n(t)$ and outputting the first filter signal $y1_n(t)$ (step ST2).

The second filter 22 receives the input signal $x_n(t)$, and performs a second filtering process of passing only the second band component (intermediate range component) in the frequency band including the first formant F1 of speech in the input signal $x_n(t)$ and outputting the second filter signal $y2_n(t)$ (step ST3).

The third filter 23 receives the input signal $x_n(t)$, and performs a third filtering process of passing only the third band component (high range component) in the frequency band including the second formant F2 of speech in the input signal $x_n(t)$ and outputting the third filter signal $y3_n(t)$ (step ST4).

The order of the first to third filtering processes is not limited to the above order, and may be any order. For example, the first to third filtering processes (steps ST2, ST3, and ST4) may be performed in parallel, or the second and third filtering processes (steps ST3 and ST4) may be performed before the first filtering process (step ST2) is performed.

The first mixer 31 receives the first filter signal $y1_n(t)$ output from the first filter 21 and the second filter signal $y2_n(t)$ output from the second filter 22, and performs a first mixing process of mixing the first filter signal $y1_n(t)$ and second filter signal $y2_n(t)$ and outputting the first mixed signal $s1_n(t)$ (step ST5A). When the sample number t is less than the value T (YES in step ST5B), the process of step ST5A is repeated until the sample number t reaches T=160.

The second mixer 32 receives the first filter signal $y1_n(t)$ output from the first filter 21 and the third filter signal $y3_n(t)$ output from the third filter 23, and performs a process of mixing the first filter signal $y1_n(t)$ and third filter signal $y3_n(t)$ and outputting the second mixed signal $s2_n(t)$ (step ST6A). When the sample number t is less than the value T (YES in step ST6B), the process of step ST6A is repeated until the sample number t reaches T=160.

The order of the above first and second mixing processes is not limited to the above example, and may be any order. For example, the above first and second mixing processes (steps ST5A and ST6A) may be performed in parallel, or the second mixing process (steps ST6A and ST6B) may be performed before the first mixing process (steps ST5A and ST5B) is performed.

The first delay controller 41 controls the first delay amount $D_1$ of the first mixed signal $s1_n(t)$ output from the first mixer 31, that is, controls the time delay of the signal. Specifically, the first delay controller 41 performs a process of outputting the first speech signal $s\tilde{}1_n(t)$ obtained by adding a time delay of $D_1$ samples to the first mixed signal $s1_n(t)$ (step ST7A). When the sample number t is less than the value T (YES in step ST7B), the process of step ST7A is repeated until the sample number t reaches T=160.

The second delay controller 42 controls the second delay amount $D_2$ of the second mixed signal $s2_n(t)$ output from the second mixer 32, that is, controls the time delay of the signal. Specifically, the second delay controller 42 performs a process of outputting the second speech signal $s\tilde{}2_n(t)$ obtained by adding a time delay of $D_2$ samples to the second mixed signal $s2_n(t)$ (step ST8A). When the sample number t is less than the value T (YES in step ST8B), the process of step ST8A is repeated until the sample number t reaches T=160.

The order of the above two delay control processes may be any order. For example, steps ST7A and ST8A may be performed in parallel, or steps ST8A and ST8B may be performed before steps ST7A and ST7B are performed.

After the processes of steps ST7A and ST8A, when the speech enhancement process is continued (YES in step ST9), the process returns to step ST1A. On the other hand, when the speech enhancement process is not continued (NO in step ST9), the speech enhancement process ends.

<<1-3>> Hardware Configuration

The hardware configuration of the speech enhancement device 100 may be implemented by, for example, a computer including a central processing unit (CPU), such as a workstation, a mainframe, a personal computer, or a microcomputer embedded in a device. Alternatively, the hardware configuration of the speech enhancement device 100 may be implemented by a large scale integrated circuit (LSI), such as a digital signal processor (DSP), an application specific integrated circuit (ASIC), or a field-programmable gate array (FPGA).

Figure 5:
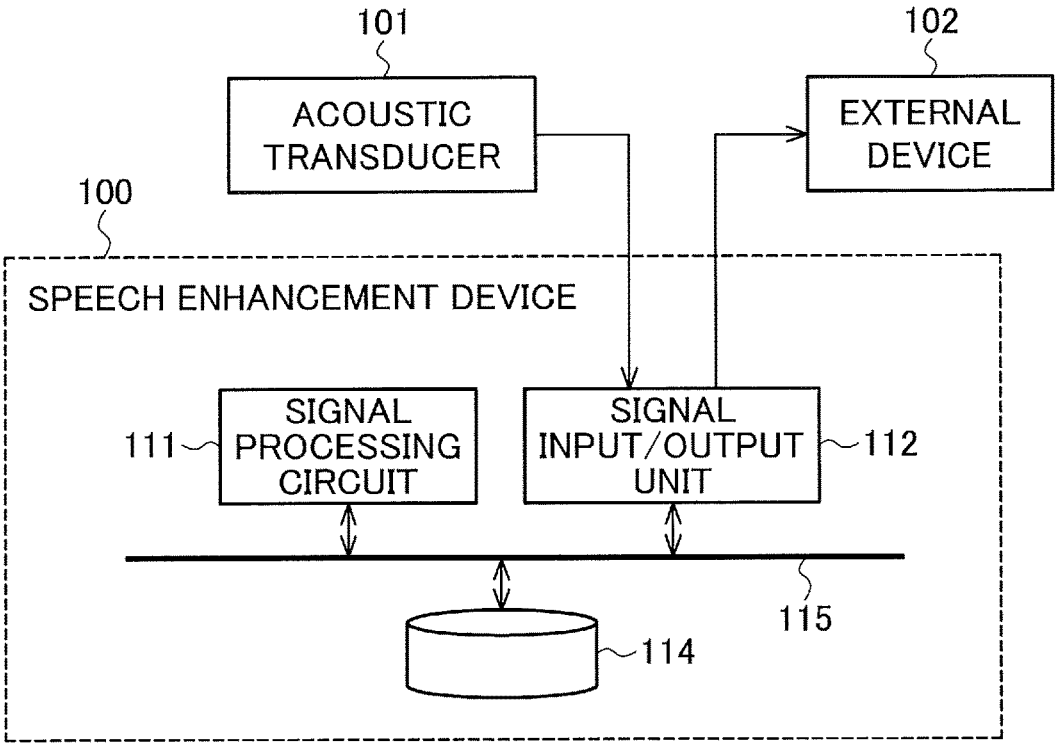
FIG. 5 is a block diagram schematically illustrating a hardware configuration (in which an integrated circuit is used) of the speech enhancement device according to the first embodiment.

FIG. 5 is a block diagram schematically illustrating a hardware configuration (in which an integrated circuit is used) of the speech enhancement device 100 according to the first embodiment. FIG. 5 illustrates an example of the hardware configuration of the speech enhancement device 100 formed using an LSI, such as a DSP, an ASIC, or an FPGA. In the example of FIG. 5, the speech enhancement device 100 is constituted by an acoustic transducer 101, a signal input/output unit 112, a signal processing circuit 111, a recording medium 114 that stores information, and a signal path 115, such as a bus. The signal input/output unit 112 is an interface circuit that provides the function of connecting the acoustic transducer 101 and an external device 102. As the acoustic transducer 101, it is possible to use, for example, a device, such as a microphone or an acoustic wave vibration sensor, that detects acoustic vibration and converts it into an electrical signal.

The respective functions of the signal input unit 11, first filter 21, second filter 22, third filter 23, first mixer 31, second mixer 32, first delay controller 41, and second delay controller 42 illustrated in FIG. 1 can be implemented by the signal processing circuit 111 and recording medium 114.

The recording medium 114 is used to store various data, such as various setting data of the signal processing circuit 111 and signal data. As the recording medium 114, it is possible to use, for example, a volatile memory, such as a synchronous DRAM (SDRAM), or a non-volatile memory, such as a hard disk drive (HDD) or a solid state drive (SSD), and the recording medium 114 can store the initial state of each filter and various setting data.

The first and second speech signals $s\tilde{}1_n(t)$ and $s\tilde{}2_n(t)$ obtained through the enhancement processing by the speech enhancement device 100 are transmitted to the external device 102 through the signal input/output unit 112. The external device 102 consists of, for example, audio acoustic processing devices provided in a television set, a hands-free telephone set, or the like. The audio acoustic processing devices are devices including a signal amplifying device, such as a power amplifier, and an audio output unit, such as a speaker.

Figure 6:
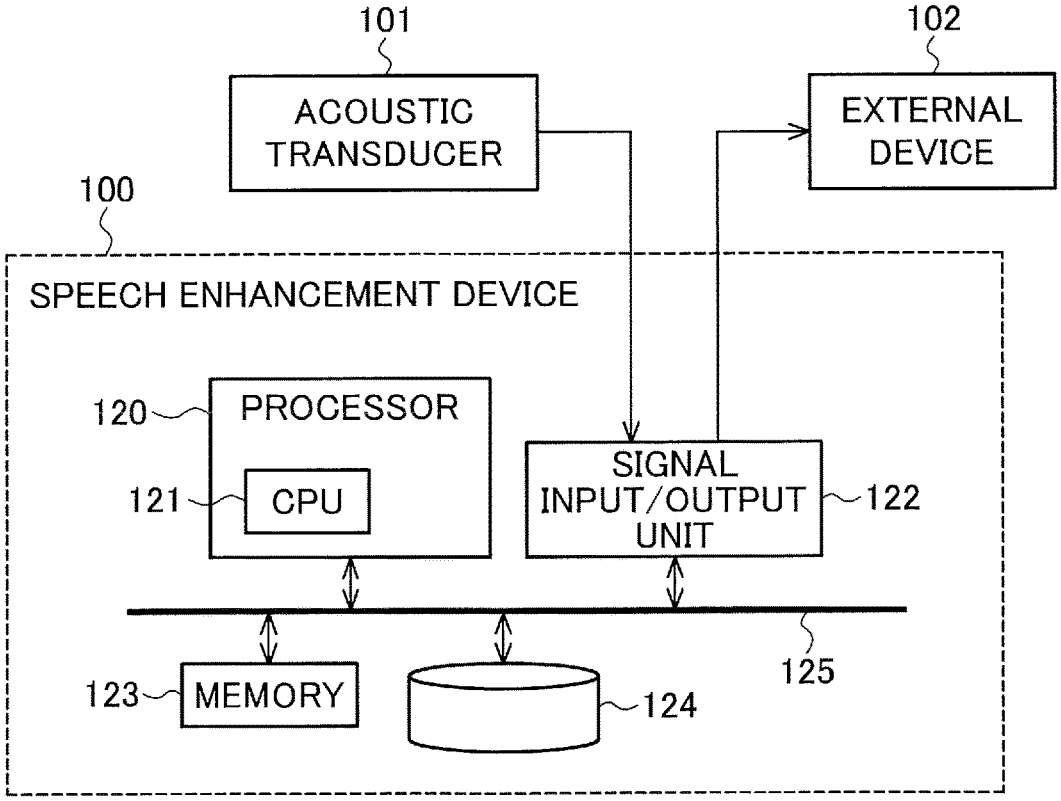
FIG. 6 is a block diagram schematically illustrating a hardware configuration (in which a program executed by a computer is used) of the speech enhancement device according to the first embodiment.

FIG. 6 is a block diagram schematically illustrating a hardware configuration (in which a program executed by a computer is used) of the speech enhancement device 100 according to the first embodiment. FIG. 6 illustrates an example of the hardware configuration of the speech enhancement device 100 formed using an arithmetic device, such as a computer. In the example of FIG. 6, the speech enhancement device 100 is constituted by a signal input/output unit 122, a processor 120 including a CPU 121, a memory 123, a recording medium 124, and a signal path 125, such as a bus. The signal input/output unit 122 is an interface circuit that provides the function of connecting an acoustic transducer 101 and an external device 102. The memory 123 is storing means, such as a read only memory (ROM) and a random access memory (RAM), used as a program memory that stores various programs for implementing the speech enhancement processing of the first embodiment, a work memory that the processor uses when performing data processing, a memory in which signal data is developed, and the like.

The respective functions of the signal input unit 11, first filter 21, second filter 22, third filter 23, first mixer 31, second mixer 32, first delay controller 41, and second delay controller 42 illustrated in FIG. 1 can be implemented by the processor 120 and recording medium 124.

The recording medium 124 is used to store various data, such as various setting data of the processor 120 and signal data. As the recording medium 124, it is possible to use, for example, a volatile memory, such as an SDRAM, or an HDD or an SSD. It can store programs including an operating system (OS), and various data, such as various setting data and acoustic signal data, such as internal states of the filters. It is also possible to store, in the recording medium 124, data in the memory 123.

The processor 120 can operate in accordance with a computer program (the speech processing program according to the first embodiment) read from a ROM in the memory 123 using a RAM in the memory 123 as a working memory, thereby performing the same signal processing as the signal input unit 11, first filter 21, second filter 22, third filter 23, first mixer 31, second mixer 32, first delay controller 41, and second delay controller 42 illustrated in FIG. 1.

The first and second speech signals $s\tilde{}1_n(t)$ and $s\tilde{}2_n(t)$ obtained through the above speech enhancement processing are transmitted to the external device 102 through the signal input/output unit 112 or 122. Examples of the external device include various types of audio signal processing devices, such as a hearing aid device, an audio storage device, and a hands-free telephone set. It is also possible to record the first and second speech signals $s\tilde{}1_n(t)$ and $s\tilde{}2_n(t)$ obtained through the speech enhancement processing, and output the recorded first and second speech signals $s\tilde{}1_n(t)$ and $s\tilde{}2_n(t)$ through separate audio output devices. The speech enhancement device 100 according to the first embodiment can be implemented by executing a software program with the separate device.

The speech processing program implementing the speech enhancement device 100 according to the first embodiment may be stored in a storage device (or memory) in a computer that executes software programs, or may be distributed using recording media, such as CD-ROMs (optical information recording media). It is also possible to acquire the program from another computer through wireless and wired networks, such as a local area network (LAN). Further, regarding the acoustic transducer 101 and external device 102 connected to the speech enhancement device 100 according to the first embodiment, various data may be transmitted and received through wireless and wired networks.

<<1-5>> Advantages

As described above, with the speech enhancement device 100, speech enhancement method, and speech processing program according to the first embodiment, it is possible to perform dichotic-listening binaural hearing aid while presenting the fundamental frequency F0 of speech to both ears, and thus it is possible to generate the first and second speech signals $s\tilde{}1_n(t)$ and $s\tilde{}2_n(t)$ that cause clear and easy-to-hear radiated speech sounds to be output.

Further, with the speech enhancement device 100, speech enhancement method, and speech processing program according to the first embodiment, it is possible to mix the first filter signal and second filter signal at an appropriate ratio to obtain the first mixed signal, mix the first filter signal and third filter signal at an appropriate ratio to obtain the second mixed signal, and use the first speech signal $s\tilde{}1_n(t)$ based on the first mixed signal and the second speech signal $s\tilde{}2_n(t)$ based on the second mixed signal to cause sounds to be output from a left speaker and a right speaker. Thus, it is possible to prevent a situation where speech is heard louder on one side or a situation where a poor auditory balance between the left and right causes discomfort, and to provide clear, easy-to-hear, and high-quality speech sounds.

Further, with the speech enhancement device 100, speech enhancement method, and speech processing program according to the first embodiment, it is possible to control the first and second delay amounts $D_1$ and $D_2$ of the first and second speech signals $s\tilde{}1_n(t)$ and $s\tilde{}2_n(t)$ to cause the sounds output from the multiple speakers to reach the ears of the user at the same time, and thus it is possible to prevent a situation where discomfort occurs because the auditory balance between the left and right is poor, e.g., speech is heard louder on one side or heard double, and to provide clear, easy-to-hear, and high-quality speech sounds.

Further, it is possible to provide a dichotic-listening binaural hearing aid method that causes less discomfort not only when used by a person with typical hearing loss but also when used by a person with mild hearing loss or a normal person, and maintains the effect of dichotic-listening binaural hearing aid even when applied to a sound radiating device using a speaker or the like, and to provide a high-quality speech enhancement device 100.

<<2>> Second Embodiment

Figure 7:
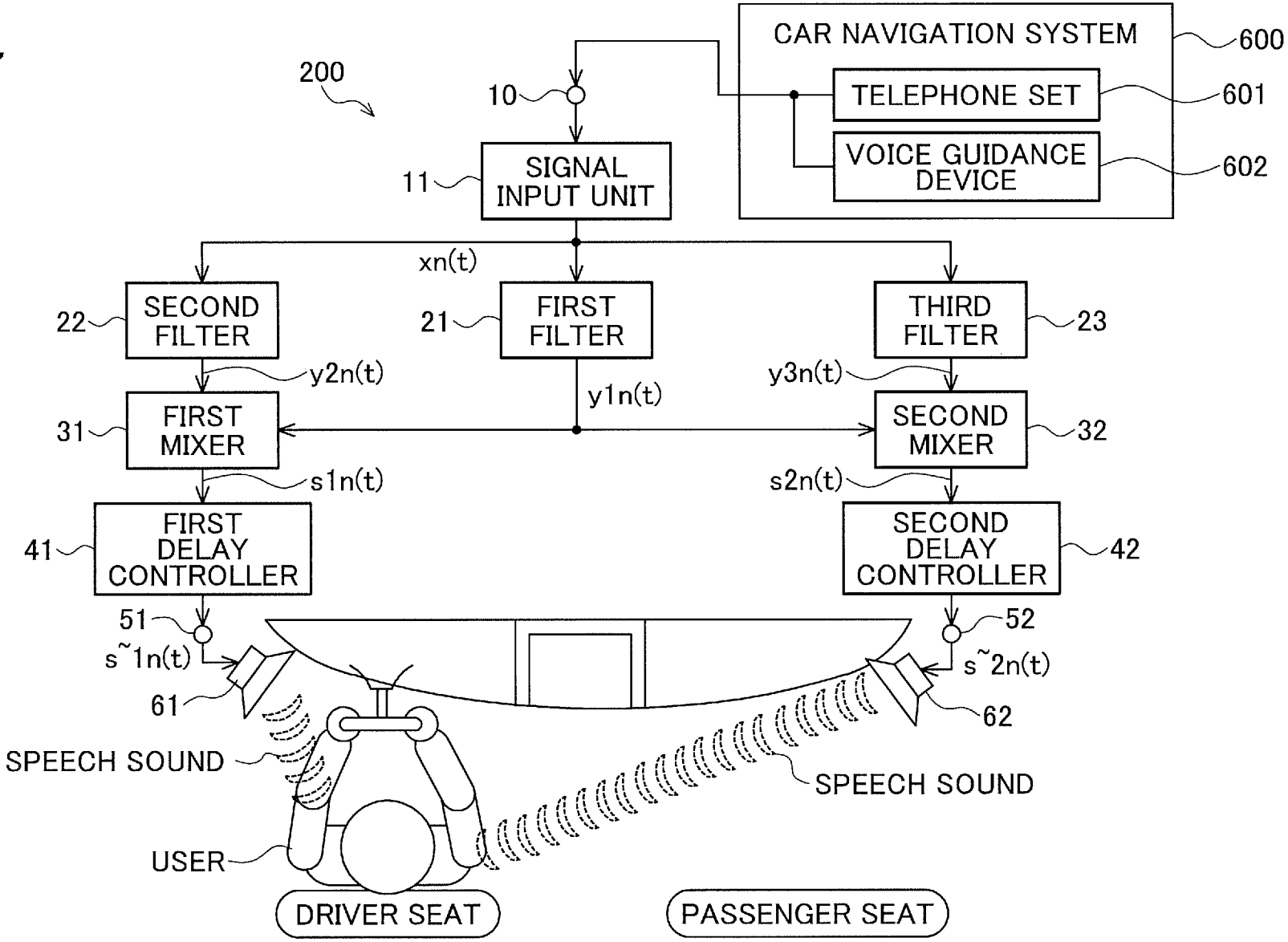
FIG. 7 is a diagram illustrating a schematic configuration of a speech enhancement device (applied to a car navigation system) according to a second embodiment of the present invention.

FIG. 7 is a diagram illustrating a schematic configuration of a speech enhancement device 200 (applied to a car navigation system) according to a second embodiment of the present invention. In FIG. 7, elements that are the same as or correspond to those illustrated in FIG. 1 are given the same reference characters as those shown in FIG. 1. The speech enhancement device 200 is a device capable of performing a speech enhancement method according to the second embodiment and a speech processing program according to the second embodiment. As illustrated in FIG. 7, the speech enhancement device 200 according to the second embodiment differs from the speech enhancement device 100 according to the first embodiment in that it includes a car navigation system 600 that supplies an input signal to the signal input unit 11 through the input terminal 10, and that it includes a left speaker 61 and a right speaker 62.

The speech enhancement device 200 according to the second embodiment processes speech from the car navigation system having an in-vehicle hands-free telephone function and a voice guidance function. As illustrated in FIG. 7, the car navigation system 600 includes a telephone set 601 and a voice guidance device 602 that provides voice messages to a driver. Otherwise, the second embodiment is the same in configuration as the first embodiment.

The telephone set 601 is, for example, a device built in the car navigation system 600, or an external device connected by wire or wirelessly. The voice guidance device 602 is, for example, a device built in the car navigation system 600. The car navigation system 600 outputs received speech output from the telephone set 601 or voice guidance device 602, to the input terminal 10.

The voice guidance device 602 also outputs voice guidance of map guidance information or the like, to the input terminal 10. The first speech signal $s\tilde{}1_n(t)$ output from the first delay controller 41 is supplied to the left (L) speaker 61 through the first output terminal 51, and the L speaker 61 outputs sound based on the first speech signal $s\tilde{}1_n(t)$. The second speech signal $s\tilde{}2_n(t)$ output from the second delay controller 42 is supplied to the right (R) speaker 62 through the second output terminal 52, and the R speaker 62 outputs sound based on the second speech signal $s\tilde{}2_n(t)$.

In FIG. 7, for example, when a user (driver) sits on a driver seat in a left-hand drive vehicle, the minimum distance between the left ear of the user sitting on the driver seat and the L speaker 61 is about 100 cm, and the minimum distance between the right ear of the user and the R speaker 62 is about 134 cm, the difference between the distance of the L speaker 61 and the distance of the R speaker 62 is about 34 cm. Since the speed of sound at room temperature is about 340 m/s, by delaying output of sound from the L speaker 61 by 1 ms, it is possible to cause sounds, specifically sounds of telephone received speech or voice guidance, output from the L speaker 61 and R speaker 62 to respectively reach the left ear and right ear at the same time. Specifically, the first delay amount $D_1$ of the first speech signal $s\tilde{}1_n(t)$ supplied from the first delay controller 41 is set to 1 ms, and the second delay amount $D_2$ of the second speech signal $s\tilde{}2_n(t)$ supplied form the second delay controller 42 is set to 0 ms (no delay). The values of the first delay amount $D_1$ and second delay amount $D_2$ are not limited to the above examples, and may be changed as appropriate depending on usage conditions, such as the positions of the L speaker 61 and R speaker 62 relative to the positions of the ears of the user. Specifically, they may be changed as appropriate depending on usage conditions, such as a distance from the speaker 61 and the left ear and a distance from the R speaker 62 to the right ear.

As described above, with the speech enhancement device 200, speech enhancement method, and speech processing program according to the second embodiment, it is possible to control the first and second delay amounts $D_1$ and $D_2$ of the first and second speech signals $s\tilde{}\mathbf{1}_n(t)$ and $s\tilde{}\mathbf{2}_n(t)$ to cause the sounds output from the multiple speakers to reach the ears of the user at the same time, and thus it is possible to prevent a situation where discomfort occurs because the auditory balance between the left and right is poor, e.g., speech is heard louder on one side or heard double, and to provide clear, easy-to-hear, and high-quality speech sounds.

Further, it is possible to provide a dichotic-listening binaural hearing aid method that causes less discomfort not only when used by a person with typical hearing loss but also when used by a person with mild hearing loss or a normal person, and maintains the effect of dichotic-listening binaural hearing aid, and to provide a high-quality speech enhancement device 200. Otherwise, the second embodiment is the same as the first embodiment.

<<3>> Third Embodiment

Figure 8:
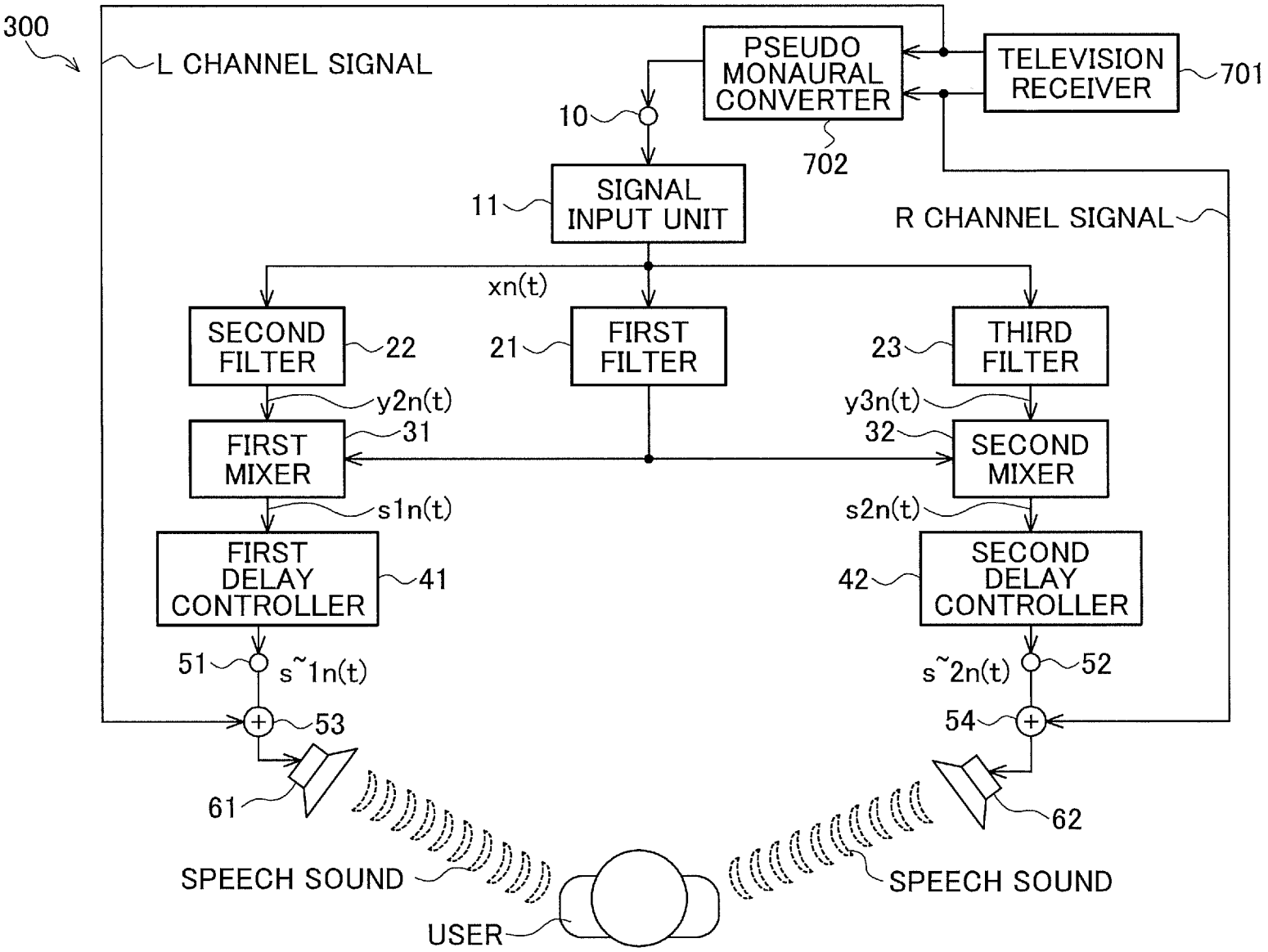
FIG. 8 is a diagram illustrating a schematic configuration of a speech enhancement device (applied to a television receiver) according to a third embodiment of the present invention.

FIG. 8 is a diagram illustrating a schematic configuration of a speech enhancement device 300 (applied to a television set) according to a third embodiment of the present invention. In FIG. 8, elements that are the same as or correspond to those illustrated in FIG. 1 are given the same reference characters as those shown in FIG. 1. The speech enhancement device 300 is a device capable of performing a speech enhancement method according to the third embodiment and a speech processing program according to the third embodiment. As illustrated in FIG. 8, the speech enhancement device 300 according to the third embodiment differs from the speech enhancement device 100 according to the first embodiment in that it includes a television receiver 701 and a pseudo monaural converter 702 that supply an input signal to the signal input unit 11 through the input terminal 10, that it includes a left speaker 61 and a right speaker 62, and that a stereo left (L) channel signal from the television receiver 701 is supplied to the L speaker 61 and a stereo right (R) channel signal from the television receiver 701 is supplied to the R speaker 62.

The television receiver 701 outputs a stereo signal consisting of the L channel signal and R channel signal using video content recorded by an external video recorder that receives broadcast waves or a video recorder built in the television receiver, for example. Although, in general, television audio signals include not only two-channel stereo signals but also multi-stereo signals having three or more channels, for the sake of simplicity of description, a case where it is a two-channel stereo signal will be described here.

The pseudo monaural converter 702 receives a stereo signal output from the television receiver 701, and extracts, for example, only speech of an announcer located at a center of the stereo signal by using a known method, such as adding to an (L+R) signal a signal opposite in phase to an (L−R) signal. Here, the (L+R) signal is a pseudo monaural signal obtained by adding the L channel signal and the R channel signal; the (L−R) signal is a signal obtained by subtracting the R channel signal from the L channel signal, that is, a pseudo monaural signal in which a signal located at a center has been attenuated.

The announcer's speech extracted by the pseudo monaural converter 702 is input into the input terminal 10, subjected to the same processing as described in the first embodiment, and added with the L channel signal and R channel signal output from the television receiver 701; then, sounds obtained through the dichotic-listening binaural hearing aid processing are output from the L speaker 61 and R speaker 62. This configuration makes it possible to enhance only the speech of the announcer located at the center of the stereo signal while maintaining the original stereo sound.

Although the third embodiment has been described using a two-channel stereo signal for the sake of simplicity of description, the method of the third embodiment may also be applied to, for example, multi-stereo signals, such as 5.1-channel stereo signals, having three or more channels, and in this case it provides the same advantages as described in the third embodiment.

Although the third embodiment has described the L speaker 61 and R speaker 62 as devices external to the television receiver 701, it is also possible to use acoustic devices, such as speakers built in the television receiver or headphones. Although the pseudo monaural converter 702 has been described as a process before the input into the input terminal 10, the stereo signal output from the television receiver 701 may be input into the input terminal 10 and then converted into a pseudo monaural signal.

As described above, with the speech enhancement device 300, speech enhancement method, and speech processing program according to the third embodiment, it is possible to provide a dichotic-listening binaural hearing aid method that enhances speech of an announcer located at a center even for a stereo signal.

Further, it is possible to provide a dichotic-listening binaural hearing aid method that causes less discomfort not only when used by a person with typical hearing loss but also when used by a person with mild hearing loss or a normal person, and maintains the effect of dichotic-listening binaural hearing aid, and to provide a high-quality speech enhancement device 300. Otherwise, the third embodiment is the same as the first embodiment.

<<4>> Fourth Embodiment

The first to third embodiments have described cases where the first speech signal $s\tilde{}\mathbf{1}_n(t)$ and second speech signal $s\tilde{}\mathbf{2}_n(t)$ are output directly to the L speaker 61 and R speaker 62. A speech enhancement device 400 according to a fourth embodiment includes crosstalk cancellers 70 that perform crosstalk cancellation processing on the first speech signal $s\tilde{}\mathbf{1}_n(t)$ and second speech signal $s\tilde{}\mathbf{2}_n(t)$.

Figure 9:
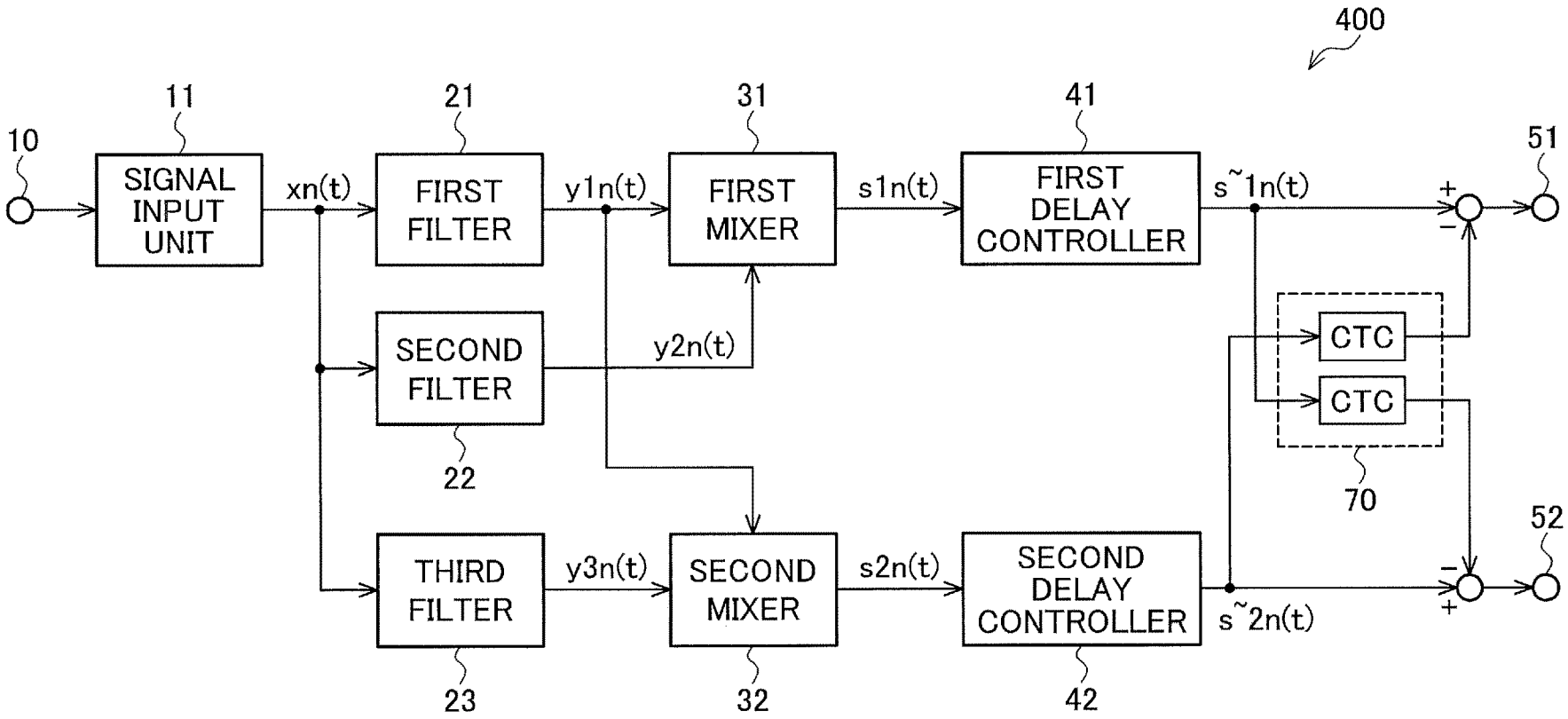
FIG. 9 is a functional block diagram illustrating a schematic configuration of a speech enhancement device according to a fourth embodiment of the present invention.

FIG. 9 is a functional block diagram illustrating a schematic configuration of the speech enhancement device 400 according to the fourth embodiment. In FIG. 9, elements that are the same as or correspond to those illustrated in FIG. 1 are given the same reference characters as those shown in FIG. 1. The speech enhancement device 400 is a device capable of performing a speech enhancement method according to the fourth embodiment and a speech processing program according to the fourth embodiment. As illustrated in FIG. 9, the speech enhancement device 400 according to the fourth embodiment differs from the speech enhancement device 100 according to the first embodiment in that it includes two crosstalk cancellers (CTC) 70. Otherwise, the fourth embodiment is the same in configuration as the first embodiment.

For example, suppose that the first speech signal $s\tilde{}\mathbf{1}_n(t)$ is a signal of an L channel sound (sound intended to be presented to only the left ear) and the second speech signal $s\tilde{}\mathbf{2}_n(t)$ is a signal of an R channel sound (sound intended to be presented to only the right ear). Although the L channel sound is a sound intended to reach only the left ear, a crosstalk component of the L channel sound actually reaches the right ear. Also, although the R channel sound is a sound intended to reach only the right ear, a crosstalk component of the R channel sound actually reaches the left ear. Thus, the crosstalk cancellers 70 cancel the crosstalk components by subtracting a signal corresponding to the crosstalk component of the L channel sound from the first speech signal $s\tilde{}1_n(t)$ and subtracting a signal corresponding to the crosstalk component of the R channel sound from the second speech signal $s\tilde{}2_n(t)$. The crosstalk cancellation processing for cancelling the crosstalk components is a known method, such as adaptive filtering.

As described above, with the speech enhancement device 400, speech enhancement method, and speech processing program according to the fourth embodiment, since the processing for cancelling the crosstalk components of the signals output from the first and second output terminals is performed, it is possible to enhance the effect of separating the two sounds reaching both ears from each other. Thus, it is possible to further enhance the effect of dichotic-listening binaural hearing aid in the case of application to a sound radiating device, and to provide a higher-quality speech enhancement device 400.

<<5>> Fifth Embodiment

While the fourth embodiment has described a case of performing dichotic-listening binaural hearing aid processing regardless of the state of the input signal, a fifth embodiment describes a case of analyzing the input signal and performing dichotic-listening binaural hearing aid processing depending on the result of the analysis. The speech enhancement device according to the fifth embodiment performs dichotic-listening binaural hearing aid processing when the input signal represents a vowel.

Figure 10:
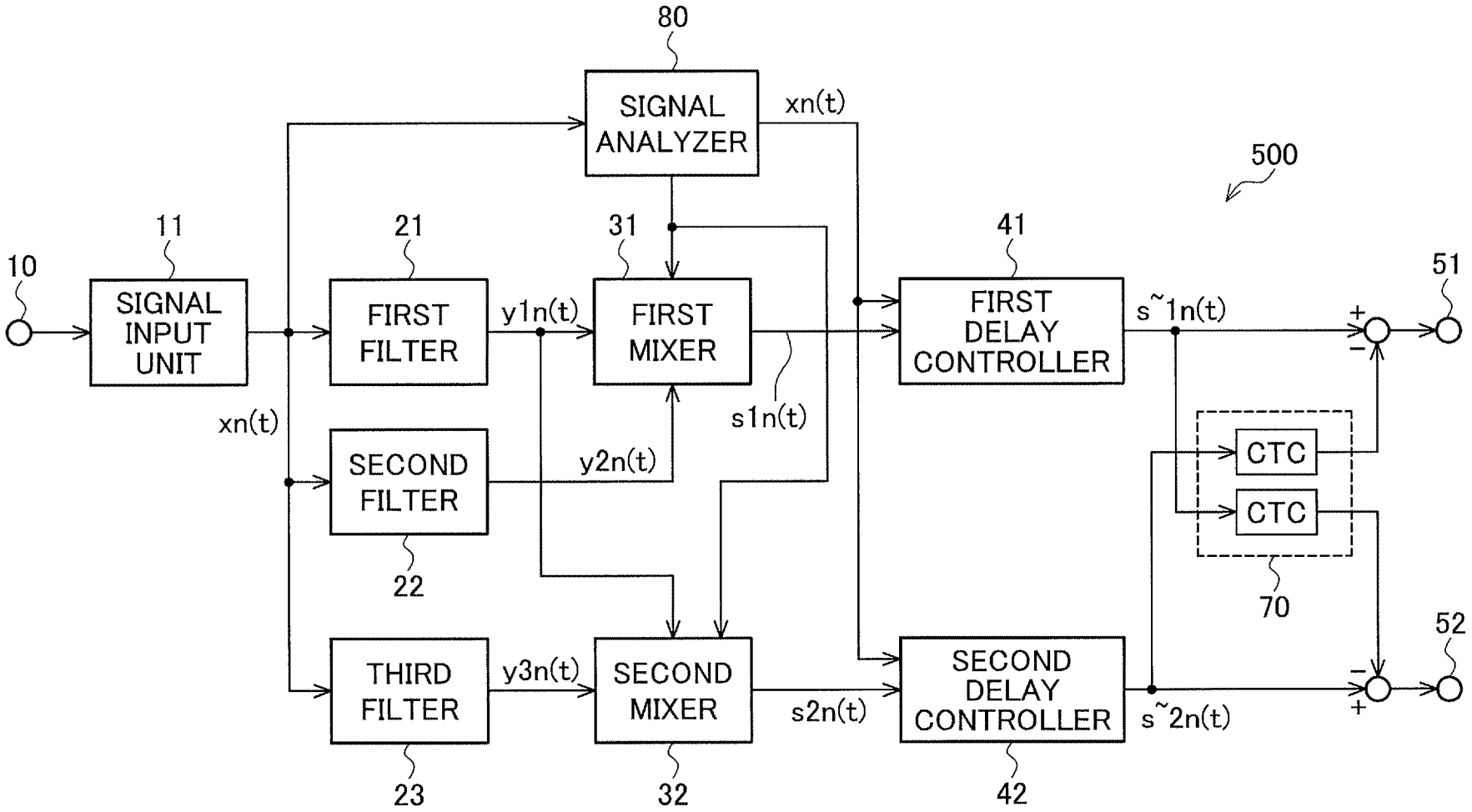
FIG. 10 is a functional block diagram illustrating a schematic configuration of a speech enhancement device according to a fifth embodiment of the present invention.

FIG. 10 is a functional block diagram illustrating a schematic configuration of a speech enhancement device 500 according to the fifth embodiment. In FIG. 10, elements that are the same as or correspond to those illustrated in FIG. 9 are given the same reference characters as those shown in FIG. 9. The speech enhancement device 500 is a device capable of performing a speech enhancement method according to the fifth embodiment and a speech processing program according to the fifth embodiment. The speech enhancement device 500 according to the fifth embodiment differs from the speech enhancement device 400 according to the fourth embodiment in that it includes a signal analyzer 80.

The signal analyzer 80 analyzes the input signal $x_n(t)$ output from the signal input unit 11 to determine whether the input signal is a signal representing a vowel or a signal representing a sound (consonant or noise) other than vowels, by using a known analyzing method, such as autocorrelation coefficient analysis. When the result of the analysis of the input signal indicates that the input signal is a signal representing a consonant or noise, the signal analyzer 80 stops the output from the first mixer 31 and second mixer 32 (i.e., stops the output of the signals obtained through the filtering processes), and directly inputs the input signal $x_n(t)$ into the first delay controller 41 and second delay controller 42. Otherwise, the fifth embodiment is the same in configuration and operation as the fourth embodiment.

Figure 11:
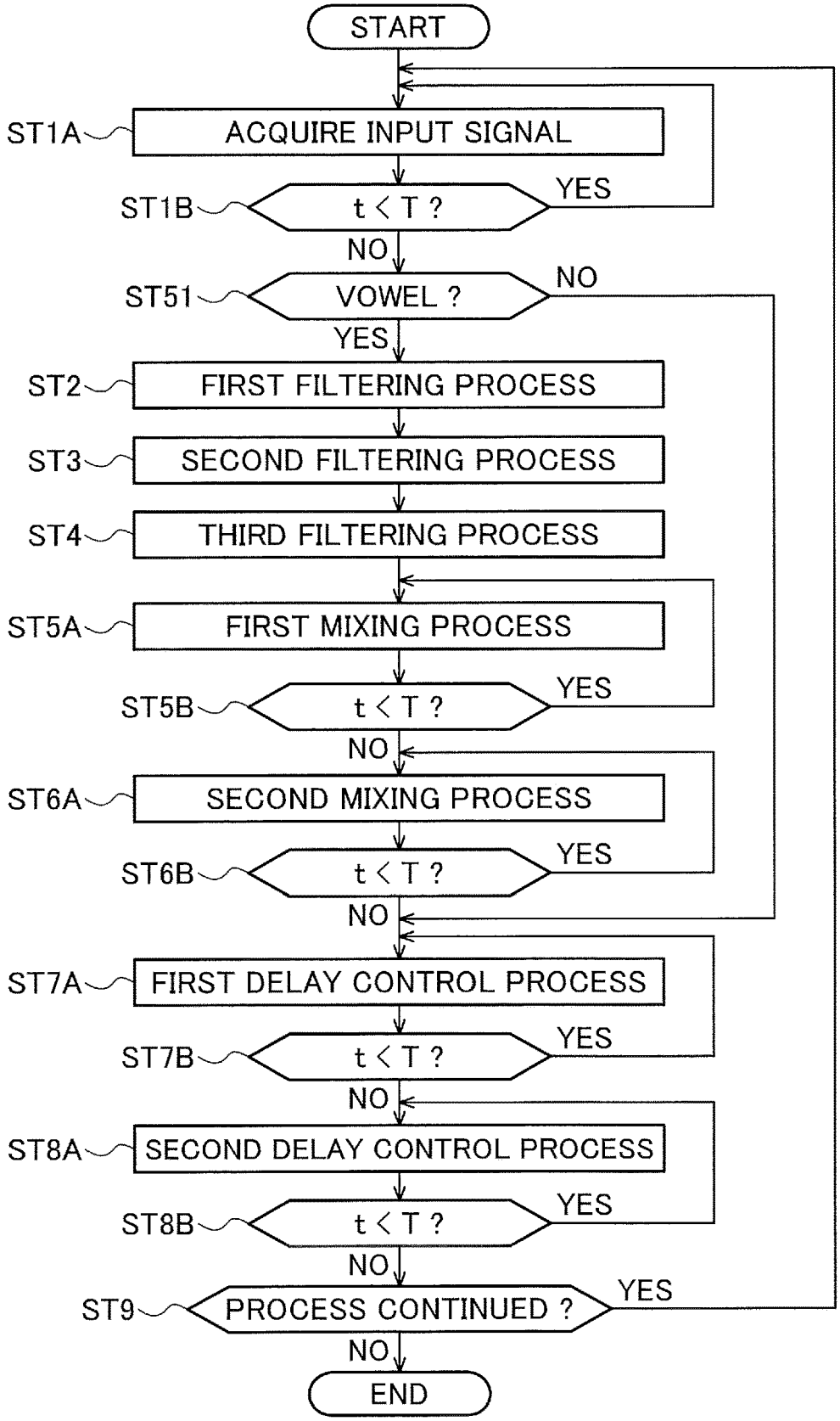
FIG. 11 is a flowchart illustrating an example of a speech enhancement process (speech enhancement method) performed by the speech enhancement device according to the fifth embodiment.

FIG. 11 is a flowchart illustrating an example of a speech enhancement process (the speech enhancement method) performed by the speech enhancement device 500 according to the fifth embodiment. In FIG. 11, process steps that are the same as those of FIG. 4 are given the same numbers as those shown in FIG. 4. The speech enhancement process performed by the speech enhancement device 500 according to the fifth embodiment differs from the process of the first embodiment in that it includes a step ST51 of determining whether the input signal is a vowel sound signal, and that it advances the process to step ST7A when the input signal is not a vowel sound signal. Except for this, the process of the fifth embodiment is the same as that of the first embodiment.

As described above, with the speech enhancement device 500, speech enhancement method, and speech processing program according to the fifth embodiment, the dichotic-listening binaural hearing aid processing can be performed depending on the state of the input signal, which avoids unnecessarily enhancing sounds, such as consonants and noises, that need no hearing aid, and makes it possible to provide a higher-quality speech enhancement device 500.

<<6>> Modifications

In the first to fifth embodiments, the first filter 21, second filter 22, and third filter 23 perform the filtering processes on the time axis. However, it is also possible that each of the first filter 21, second filter 22, and third filter 23 is constituted by a fast Fourier transformer (FFT unit), a filtering processor that performs a filtering process on the frequency axis, and an inverse fast Fourier transformer (IFFT unit). In this case, each of the filtering processors of the first filter 21, second filter 22, and third filter 23 can be implemented by setting a spectral gain within the passband to 1 and setting spectral gains within attenuation bands to 0.

Although the first to fifth embodiments have described cases where the sampling frequency is 16 kHz, the sampling frequency is not limited to this value. For example, the sampling frequency can be set to another frequency, such as 8 kHz or 48 kHz.

The second and third embodiments have described examples where the speech enhancement devices are applied to the car navigation system and television receiver. However, the speech enhancement devices according to the first to fifth embodiments are applicable to systems or devices including multiple speakers other than car navigation systems and television receivers. The speech enhancement devices according to the first to fifth embodiments are applicable to, for example, voice guidance systems in exhibition sites or the like, teleconference systems, voice guidance systems in trains, and the like.

In the first to fifth embodiments, elements may be modified, added, or omitted within the scope of the present invention.

INDUSTRIAL APPLICABILITY

The speech enhancement devices, speech enhancement methods, and speech processing programs according to the first to fifth embodiments are applicable to audio communication systems, audio storage systems, and sound radiating systems.

When the speech enhancement device of any one of the first to fifth embodiments is applied to an audio communication system, the audio communication system includes, in addition to the speech enhancement device, a communication device for transmitting signals output from the speech enhancement device and receiving signals input into the speech enhancement device.

When the speech enhancement device of any one of the first to fifth embodiments is applied to an audio storage system, the audio storage system includes, in addition to the speech enhancement device, a storage device (or memory) that stores information, a writing device that stores the first and second speech signals $s\tilde{}1_n(t)$ and $s\tilde{}2_n(t)$ output from the speech enhancement device into the storage device, and a reading device that reads the first and second speech signals $s\tilde{}1_n(t)$ and $s\tilde{}2_n(t)$ from the storage device and inputs them into the speech enhancement device.

When the speech enhancement device of any one of the first to fifth embodiments is applied to a sound radiating system, the sound radiating system includes, in addition to the speech enhancement device, an amplifying circuit that amplifies the signals output from the speech enhancement device, and multiple speakers that output sounds based on the amplified first and second speech signals $s\tilde{}1_n(t)$ and $s\tilde{}2_n(t)$.

The speech enhancement devices, speech enhancement methods, and speech processing programs according to the first to fifth embodiments are also applicable to car navigation systems, mobile phones, intercoms, television sets, hands-free telephone systems, and teleconference systems. When it is applied to one of the systems and devices, the first speech signal $s\tilde{}1_n(t)$ for one ear and the second speech signal $s\tilde{}2_n(t)$ for the other ear are generated from a speech signal output from the system or device. The user of the system or device to which one of the first to fifth embodiments is applied can clearly perceive speech.

REFERENCE SIGNS LIST

10 input terminal, 11 signal input unit, 21 first filter, 22 second filter, 23 third filter, 31 first mixer, 32 second mixer, 41 first delay controller, 42 second delay controller, 51 first output terminal, 52 second output terminal, 61 L speaker, 62 R speaker, 100, 200, 300, 400, 500 speech enhancement device, 101 acoustic transducer, 111 signal processing circuit, 112 signal input/output unit, 114 recording medium, 115 signal path, 120 processor, 121 CPU, 122 signal input/output unit, 123 memory, 124 recording medium, 125 signal path, 600 car navigation system, 601 telephone set, 602 voice guidance device, 701 television receiver, 702 pseudo monaural converter.

The invention claimed is:

1. A speech enhancement device to receive an input signal and generate, from the input signal, a first speech signal for a first ear and a second speech signal for a second ear opposite the first ear, the speech enhancement device comprising:

a first filter to extract, from the input signal, a first band component that is a speech component in a predetermined frequency band including a fundamental frequency of speech, and output the first band component as a first filter signal;

a second filter to extract, from the input signal, a second band component in a predetermined frequency band including a first formant of speech, and output the second band component as a second filter signal;

a third filter to extract, from the input signal, a third band component in a predetermined frequency band including a second formant of speech, and output the third band component as a third filter signal;

a first mixer to mix the first filter signal and the second filter signal, and thereby output a first mixed signal;

a second mixer to mix the first filter signal and the third filter signal, and thereby output a second mixed signal;

a first delay controller to delay the first mixed signal by a predetermined first delay amount, and thereby generate the first speech signal; and a second delay controller to delay the second mixed signal by a predetermined second delay amount, and thereby generate the second speech signal, wherein the first filter signal is a common signal input to both the first mixer and the second mixer, wherein the speech enhancement device further comprises a signal analyzer to analyze a state of the input signal, and wherein signals input to the first and second delay controllers are switched from the first and second mixed signals to the input signal depending on a result of the analysis by the signal analyzer.

2. The speech enhancement device of claim 1, wherein the first mixer mixes the first filter signal and the second filter signal at a predetermined first mixing ratio; and the second mixer mixes the first filter signal and the third filter signal at a predetermined second mixing ratio.

3. The speech enhancement device of claim 1, wherein the first delay amount is a time not less than 0;

the second delay amount is a time not less than 0; and the first delay amount differs from the second delay amount.

4. The speech enhancement device of claim 1, further comprising:

a first speaker to output sound based on the first speech signal; and a second speaker to output sound based on the second speech signal, wherein the first delay amount and the second delay amount are predetermined on a basis of a distance from the first speaker to the first ear and a distance from the second speaker to the second ear.

5. The speech enhancement device of claim 1, further comprising:

a first speaker to output sound based on the first speech signal;

a second speaker to output sound based on the second speech signal; and a crosstalk canceller to cancel a crosstalk component of the sound based on the second speech signal reaching the first ear from the second speaker and a crosstalk component of the sound based on the first speech signal reaching the second ear from the first speaker.

6. The speech enhancement device of claim 1, wherein when the input signal is not a signal indicating a vowel, the signal analyzer switches the signals input to the first and second delay controllers from the first and second mixed signals to the input signal.

7. The speech enhancement device of claim 1, wherein the first filter signal is input only to both the first mixer and the second mixer.

8. A speech enhancement method for receiving an input signal and generating, from the input signal, a first speech signal for a first ear and a second speech signal for a second ear opposite the first ear, the speech enhancement method comprising:

extracting, from the input signal, a first band component that is a speech component in a predetermined frequency band including a fundamental frequency of speech, and outputting the first band component as a first filter signal;

extracting, from the input signal, a second band component in a predetermined frequency band including a first formant of speech, and outputting the second band component as a second filter signal;

extracting, from the input signal, a third band component in a predetermined frequency band including a second formant of speech, and outputting the third band component as a third filter signal;

mixing the first filter signal and the second filter signal, and thereby outputting a first mixed signal;

mixing the first filter signal and the third filter signal, and thereby outputting a second mixed signal;

delaying, by a first delay controller, the first mixed signal by a predetermined first delay amount, and thereby generating the first speech signal; and delaying, by a second delay controller, the second mixed signal by a predetermined second delay amount, and thereby generating the second speech signal, wherein the first filter signal is a common signal used in both the mixing the first filter signal and the second filter signal and the mixing the first filter signal and the third filter signal, and wherein the speech enhancement method further comprises:

analyzing a state of the input signal, and switching signals input to the first and second delay controllers from the first and second mixed signals to the input signal depending on a result of the analysis.

9. The speech enhancement method of claim 8, wherein the first filter signal is only used in both the mixing the first filter signal and the second filter signal and the mixing the first filter signal and the third filter signal.

10. A non-transitory computer-readable storage medium storing a speech processing program for causing a computer to execute a process of generating, from an input signal, a first speech signal for a first ear and a second speech signal for a second ear opposite the first ear, the process comprising:

extracting, from the input signal, a first band component that is a speech component in a predetermined frequency band including a fundamental frequency of speech, and outputting the first band component as a first filter signal;

extracting, from the input signal, a second band component in a predetermined frequency band including a first formant of speech, and outputting the second band component as a second filter signal;

extracting, from the input signal, a third band component in a predetermined frequency band including a second formant of speech, and outputting the third band component as a third filter signal;

mixing the first filter signal and the second filter signal, and thereby outputting a first mixed signal;

mixing the first filter signal and the third filter signal, and thereby outputting a second mixed signal;

delaying, by a first delay controller, the first mixed signal by a predetermined first delay amount, and thereby generating the first speech signal; and delaying, by a second delay controller, the second mixed signal by a predetermined second delay amount, and thereby generating the second speech signal, wherein the first filter signal is a common signal used in both the mixing the first filter signal and the second filter signal and the mixing the first filter signal and the third filter signal, and wherein the process further comprises:

analyzing a state of the input signal, and switching signals input to the first and second delay controllers from the first and second mixed signals to the input signal depending on a result of the analysis.

11. The non-transitory computer-readable storage medium of claim 10, wherein the first filter signal is only used in both the mixing the first filter signal and the second filter signal and the mixing the first filter signal and the third filter signal.

* * * * *